US010228156B1

(12) United States Patent
Pisaturo, III

(10) Patent No.: US 10,228,156 B1
(45) Date of Patent: Mar. 12, 2019

(54) SWING GATES FOR ACCESSING CONDENSER UNIT HOUSINGS

(71) Applicant: Heatcraft Refrigeration Products LLC, Richardson, TX (US)

(72) Inventor: Anthony J. Pisaturo, III, Loganville, GA (US)

(73) Assignee: Heatcraft Refrigeration Products LLC, Richardson, TX (US)

( * ) Notice: Subject to any disclaimer, the term of this patent is extended or adjusted under 35 U.S.C. 154(b) by 50 days.

(21) Appl. No.: 15/690,253

(22) Filed: Aug. 29, 2017

(51) Int. Cl.
*F24F 13/20* (2006.01)
*F24F 1/58* (2011.01)
*F24F 1/56* (2011.01)

(52) U.S. Cl.
CPC ..... *F24F 13/20* (2013.01); *F24F 1/56* (2013.01); *F24F 1/58* (2013.01); *F24F 2013/202* (2013.01)

(58) Field of Classification Search
CPC ..... F24F 1/56; F24F 1/58; F24F 13/20; F24F 13/202; F24F 13/205; F24F 13/207; F24F 13/084
See application file for complete search history.

(56) References Cited

U.S. PATENT DOCUMENTS

| | | | | |
|---|---|---|---|---|
| 3,789,619 | A * | 2/1974 | Kincaid | F24F 13/20 62/262 |
| 5,029,452 | A * | 7/1991 | Mourabet | F24F 13/20 220/242 |
| 5,600,963 | A * | 2/1997 | Koo | F24F 13/20 454/332 |
| 6,526,773 | B1 * | 3/2003 | Cho | F24F 13/085 62/262 |
| 2003/0011290 | A1 * | 1/2003 | Austin | F24F 3/0442 312/326 |
| 2010/0319380 | A1 * | 12/2010 | Mochizuki | F24F 1/06 62/259.1 |

* cited by examiner

*Primary Examiner* — Eric Ruppert
(74) *Attorney, Agent, or Firm* — Hubbard Johnston, PLLC

(57) ABSTRACT

A condenser unit housing of a refrigeration system has an outer walls and a top cover. An opening formed in one of the outer walls and framed by the top cover and sidewalls, the opening having a width W1 between the sidewalls. The housing includes a swing gate positioned within the opening when in a closed position and contacting the top cover when in an open position. The swing gate includes first rods having a width W2 less than the width W1, second rods coupled to the first rods, the second rods extending in a direction different than the first rods, and a pivot rod. The second rods include a straight section and a curved section. The pivot rod is coupled to the curved section and has a width W3 greater than the width W1. The pivot rod is below the top cover in both the open position and the closed position. Other embodiments are presented.

20 Claims, 16 Drawing Sheets

SWING GATES FOR ACCESSING CONDENSER UNIT HOUSINGS

TECHNICAL FIELD

This application is directed, in general, to condenser unit housings for refrigeration systems, and more specifically, to swing gates for accessing condenser unit housings.

BACKGROUND

Air conditioning and refrigeration systems provide cooling, ventilation and humidity control for all or part of a climate-controlled area such as a refrigerator, a cooler, a building and the like. Generally, a refrigeration cycle includes four basic stages to provide cooling. First, a vapor refrigerant is compressed at high pressure and high temperature using one or more compressors. Second, the compressed vapor refrigerant is cooled into a liquid using condensers or compressers. The condensers may utilize a fan to move ambient air across condenser coils to provide a heat exchange. Third, the liquid refrigerant is passed through an expansion device that reduces the pressure and further reduces the temperature of the liquid refrigerant. The liquid refrigerant is then pumped within the climate-controlled area to one or more evaporators. The liquid refrigerant absorbs heat from the surroundings in an evaporator coil, causing the liquid refrigerant to evaporate back into a vapor. Finally, the vapor refrigerant returns to the compressor and the cycle repeats. Various alternatives on this basic refrigeration cycle are known and may be used herein.

The evaporator, in a typical refrigeration system, is positioned inside the climate-controlled area to transfer heat from the climate-controlled area to the refrigerant. The remaining components are typically positioned outside the climate-controlled area and may be positioned within a condenser unit housing. The condenser unit housing may include one or more compressors, a condenser coil and a fan assembly. The condenser dispenses the heat from the climate-controlled area to the ambient surroundings or elsewhere.

SUMMARY

According to an illustrative embodiment, a refrigeration system comprises a closed refrigeration circuit having a plurality of fluidly coupled conduits, a condenser fluidly coupled to the plurality of conduits, an expansion device fluidly coupled to the plurality of conduits, an evaporator fluidly coupled to the plurality of conduits, and a compressor fluidly coupled to the plurality of conduits. The condenser includes a housing having a plurality of sidewalls, a top cover and an access opening formed on an exterior of the housing. The access opening is at least partially framed by a first sidewall and a second, opposing sidewall, with the access opening having an access-opening width W1 between the first sidewall and the second sidewall. The housing further includes a swing gate operable to cover the access opening in a closed position. The swing gate comprises a first plurality of rods extending in a horizontal direction having a width W2 that is less than the access-opening width W1 and a second plurality of rods coupled to the first plurality of rods, the second plurality of rods perpendicular to the first plurality of rods, wherein the second plurality of rods includes a vertical section that is vertical when in the closed position and a curved section. The curved section has a back portion laterally offset from the vertical section a first distance D1 and a terminus laterally offset from the vertical section a second distance D2, wherein the first distance D1 is greater than the second distance D2. The swing gate further comprises a pivot rod extending in the horizontal direction and coupled to the terminus.

According to another illustrative embodiment, a condenser unit for use in a refrigeration system includes a condenser unit housing having outer walls, a top cover and an access opening formed in one of the outer walls of the housing. The access opening is at least partially framed by the top cover, a first sidewall and a second, opposing sidewall. The access opening has a width W1 between the first sidewall and the second sidewall. The housing further includes a swing gate configured to be positioned within the access opening when the swing gate is in a closed position and contacting an upper surface of the top cover when the swing gate is in an open position. The swing gate comprises a first plurality of rods extending in a horizontal direction such that the first plurality of rods having a width W2 that is less than the access-opening width W1. A second plurality of rods are coupled to the first plurality of rods. The second plurality of rods extend in a direction different than the first plurality of rods, wherein the second plurality of rods include a straight section and a curved section. The swing gate further comprises a horizontal, pivot rod coupled to the second plurality of rods in the curved section. The horizontal, pivot rod has a width W3 that is greater than the width W1 of the access opening. The horizontal, pivot rod is below the top cover in both the open position and the closed position.

According to yet another illustrative embodiment, a method for accessing an interior of a condenser unit for use in a refrigeration system is presented. The condenser includes a housing with an access opening on an exterior of the housing and a swing gate for blocking the access opening in a closed position. The method comprises unlocking the swing gate from the housing, the housing having a plurality of sidewalls, a top cover and the swing gate. The swing gate includes a first plurality of rods in a horizontal direction having a width W2 less than an access-opening width W1, a second plurality of rods coupled to the first plurality of rods, and a pivot rod. The second plurality of rods include a vertical section and a curved section, wherein in the curved section, the second plurality of rods are shaped to include a back portion laterally offset from the vertical section a first distance D1 and a terminus laterally offset from the vertical section a second distance D2, wherein the first distance D1 is greater than the second distance D2. The pivot rod is coupled to the terminus of at least some of the second plurality of rods. The pivot rod has a width W3 that is greater than the access-opening width W1. The method further includes sliding at least a portion of the swing gate laterally within the access opening and rotating the swing gate about the pivot rod until the curved section of the second plurality of rods contacts the top cover of the housing.

DESCRIPTION OF THE DRAWINGS

Illustrative embodiments of the present invention are described in detail below with reference to the attached drawing figures, which are incorporated by reference herein and wherein.

DETAILED DESCRIPTION

The condenser unit housing of a refrigerations system, is generally provided with an access opening, with attached gate, on an outer wall of the condenser unit housing to allow maintenance personal access to the components within the condenser unit housing. A gate that does not require complete removal from the housing for access to the interior of the housing and that does not require the locking mechanism to be completely removed from the housing may be beneficial.

Figure 1:
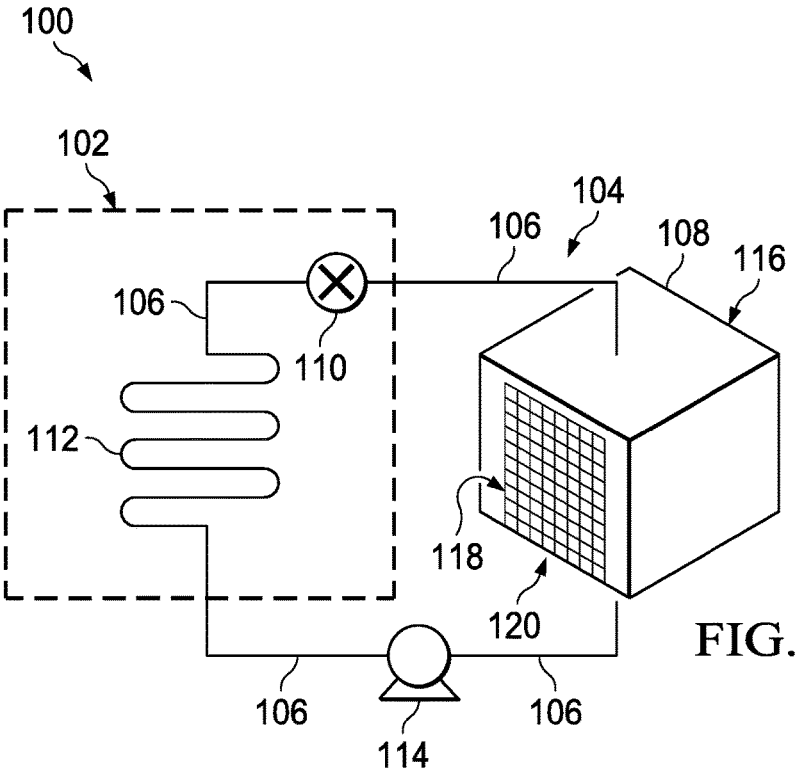
FIG. 1 is a schematic diagram of a refrigeration unit with a condenser unit housing, according to an illustrative embodiment.

Referring to FIG. 1, an illustrative embodiment of a refrigeration system 100 is presented. The refrigeration system 100 is used to cool a climate-controlled area or a refrigerated space 102, which may include a refrigerator, cooler, building or the like.

The refrigeration system 100 includes a closed refrigeration circuit 104 having a plurality of fluidly coupled conduits 106 connecting various aspects of the closed refrigeration circuit 104. The closed refrigeration circuit 104 further includes a condenser 108 fluidly coupled to the plurality of conduits 106, an expansion device 110 fluidly coupled to the plurality of conduits 106, an evaporator 112 fluidly coupled to the plurality of conduits 106 and a compressor 114 fluidly coupled to the plurality of conduits 106. A refrigerant (not shown) flows through the closed refrigeration circuit 104. The refrigerant may include conventional refrigerants such as hydrofluorocarbons, carbon dioxide and other suitable refrigerants. It should be appreciated, that multiple refrigeration cycles may use differing refrigerants in the same refrigeration system.

The expansion device 110 may include an expansion valve position between and fluidly coupled to both the condenser 108 and the evaporator 112. In one embodiment, the expansion device 110 is located in the refrigerated space 102. In another embodiment, the expansion device 110 is located outside of the refrigerated space 102 and is adjacent to or housed next to the condenser 108. Generally, the expansion device 110 reduces the pressure and temperature of the refrigerant outputted from the condenser 108, which is then fed to the evaporator 112. The expansion device 110 may be any conventional design and may have any suitable size, shape, configuration or capacity.

The evaporator 112 may be comprised of one or more evaporators that include one or more evaporator coils and one or more evaporator fans (not shown). In FIG. 1, the evaporator 112 is shown as being positioned within the refrigerated space 102. However, in some embodiments, the evaporator 112 may be adjacent to the refrigerated space 102. In operation, the evaporator fans draw air from the refrigerated space 102 over the evaporator coils to provide a heat exchange with the refrigerant flowing through the evaporator 112. The evaporator 112 may be any design and be any suitable size, shape, configuration or capacity.

The compressor 114 may include one or more compressors. The compressor 114 is positioned between and fluidly coupled to both the evaporator 112 and the condenser 108. In FIG. 1, the compressor 114 is not housed with the condenser 108. However, in some embodiments, the compressor 114 is housed with the condenser 108. The compressor 114 compresses the refrigerant received from the evaporator 112 before the refrigerant is fed to the condenser 108. The compressor 114 acts on the refrigerant to increase the pressure of the refrigerant before the refrigerant is fed to the condenser 108. The compressor 114 may be any conventional design and may be any suitable size, shape, configuration or capacity.

The condenser 108 may be a gas cooler and may include one or more condenser coils (not shown) and one or more condenser fans (not shown). In operation, the condenser fans pull in ambient air or cooling air over the condenser coils to provide a heat exchange with the refrigerant flowing through the condenser 108. The condenser 108 may be any design and may have any suitable size, shape, configuration or capacity.

The condenser 108 is housed in a condenser unit housing 116. An access opening 118 is formed in the condenser unit housing 116 to allow a technician to access the condenser 108 or other components that are housed within the condenser unit housing 116, while also allowing air flow. The condenser unit housing 116 includes a swing gate 120 configured to block the access opening 118, which may be used to prevent unauthorized personnel or animals from gaining access to the contents within the condenser unit housing 116 and yet allows air flow. Embodiments of the condenser unit housing 116 will be described in more detail below with reference to FIGS. 2-9C. Throughout the figures, like numerals will be used to refer to like elements.

Figure 2:
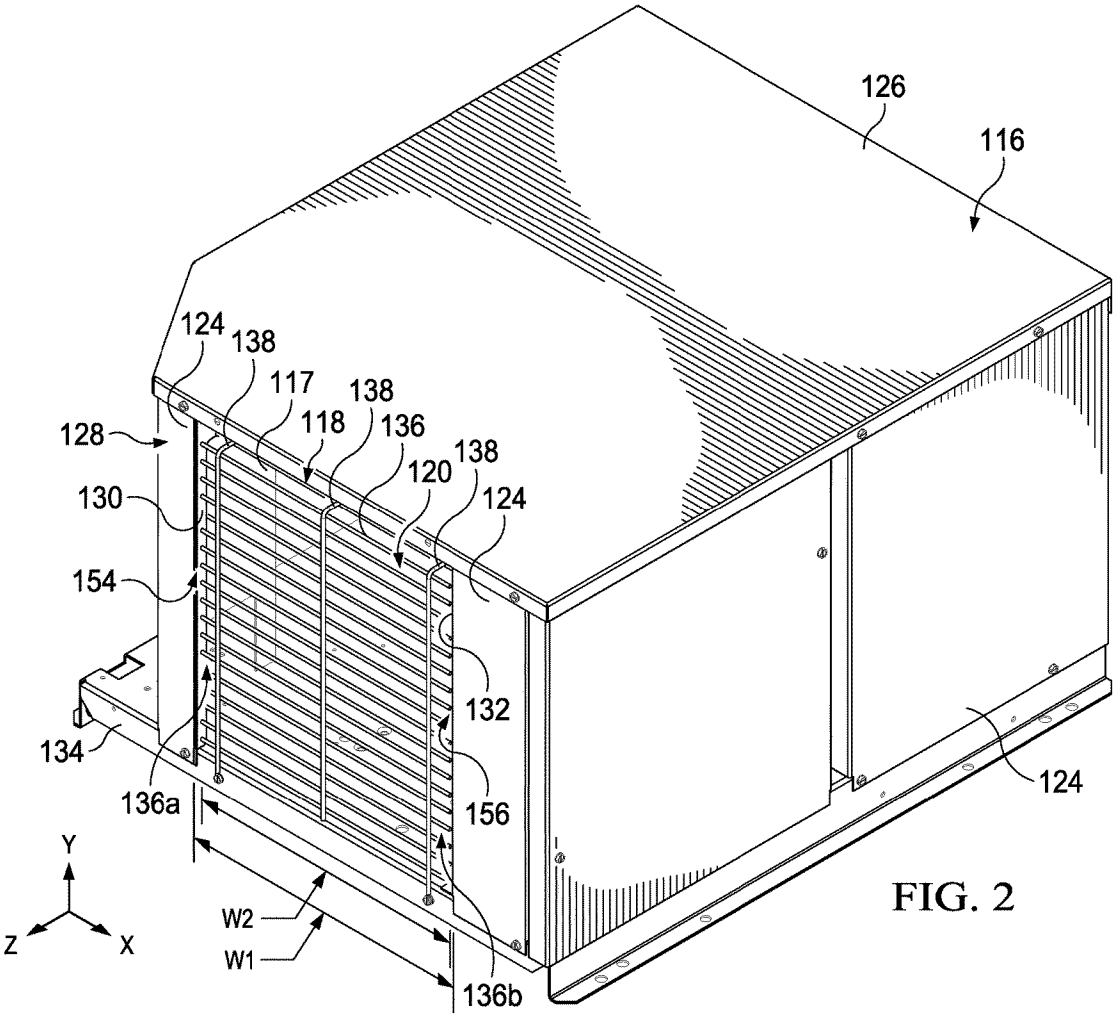
FIG. 2 is a schematic, perspective view of a portion of a condenser unit housing having a swing gate in a closed position, according to an illustrative embodiment.

Referring now primarily to FIG. 2, the condenser unit housing 116 is shown with the swing gate 120 in a closed position 122. When in the closed position 122, the swing gate 120 is operable to cover the access opening 118 or otherwise prevent a person or animal from bodily accessing an interior 117 of the condenser unit housing 116. The condenser unit housing 116 has a plurality of sidewalls 124, which may include inner and outer walls, and a top cover 126 that is removable from the plurality of sidewalls 124. The top cover 126 helps secure components within the condenser unit housing 116, and, in some embodiments, protects the components within the condenser unit housing 116 from, for example, rain, snow or the like. The access opening 118 is formed on an exterior 128 of the condenser unit housing 116, with the access opening 118 being at least partially framed by a first sidewall 130 and a second, opposing sidewall 132. In some embodiments, the access opening 118 may further be framed by a bottom panel 134 and the top cover 126. The access opening 118 has an access-opening width W1 extending between the first sidewall 130 and the second sidewall 132. The access opening 118 will generally be sized to allow a user or technician to bodily or physically access the access opening 118.

Referring now primarily to FIGS. 3A-3D, but with continued reference to FIG. 2, the swing gate 120 includes a first plurality of rods 136 connected to a second plurality of rods 138, where the second plurality of rods 138 extend in a direction different from the first plurality of rods 136, e.g., orthogonally or diagonally. In an illustrative embodiment, the first plurality of rods 136 extend in a horizontal direction with all of the first plurality of rods 136 having the same width. In non-limiting embodiments, the second plurality of rods 138 may be perpendicular to the first plurality of rods 136. The second plurality of rods 138 may have differing overall lengths or heights from each other. Generally, the number of the first plurality of rods 136 is greater than the number of the second plurality of rods 138. In an illustrative, nonlimiting embodiment, there may be two times or more of the first plurality of rods 136 than the second plurality of rods 138. The rods 136, 138 may be welded or attached using other technologies.

Each of the first plurality of rods 136 may have a uniform diameter or thickness. In a nonlimiting embodiment, the first plurality of rods 136 may be formed of 9 gauge rods, 10 gauge rods or the like. Similarly, in some embodiments, each of the second plurality of rods 138 may also have a uniform diameter or thickness and, in a nonlimiting embodiment, formed of 9 gauge rods, 10 gauge rods or the like. The first plurality of rods 136 may have the same diameter or a different diameter than the second plurality of rods 138. In some aspects, the second plurality of rods 138 may have a larger diameter than the first plurality of rods 136. The second plurality of rods 138 may have a larger diameter than the first plurality of rods 136 so as to provide structural support for the first plurality of rods 136 and, generally, the swing gate 120.

The first plurality of rods 136 have a width W2 (FIG. 3B) that is less than the access-opening width W1 (FIG. 2). When the swing gate 120 is in the closed position 122, a first gap 154 (FIG. 2) may be formed between the first sidewall 130 of the access opening 118 and a first end 136*a* of the first plurality of rods 136 and a second gap 156 may be formed between the second sidewall 132 of the access opening 118 and a second, opposing end 136*b* of the first plurality of rods 136. The width W2 of the first plurality of rods 136 is measured from the first end 136*a* to the second, opposing end 136*b*, i.e., between the distal ends of the first plurality of rods 136. In some embodiments, the first plurality of rods 136 are flush with or internal to the exterior 128 of the condenser unit housing 116, while being between the first sidewall 130 and the second sidewall 132. In some embodiments, the first gap 154 is substantially the same distance as the second gap 156.

The second plurality of rods 138 includes a straight or vertical section 140 and a curved section 142. Thus, the swing gate 120 also includes a straight or vertical section 141 and a curved section 143 the corresponds to the straight or vertical section 140 and the curved section 142 of the second plurality of rods 138 when the first plurality of rods 136 are connected to the second plurality of rods 138.

The straight section 140 and the curved section 142 of each of the second plurality of rods 138 may be formed from a single rod that is bent to form the curved section 142. The straight section 140 of the second plurality of rods 138 is generally vertical when the swing gate 120 is in the closed position 122. The curved section 142 of the second plurality of rods 138 extends from the vertical section 140. The curved section 142 has a height H1 (FIG. 3C) and the vertical section 140 has a height H2. In an illustrative, nonlimiting embodiment, the height H1 of the curved section 142 may be approximately 10 percent of the height H2 of the vertical section 140. The height H1 of the curved section 142 together with the height H2 of the vertical section 140 equals the total height of the second plurality of rods 138, which also equals a height H3 of the swing gate 120.

Figure 3A:
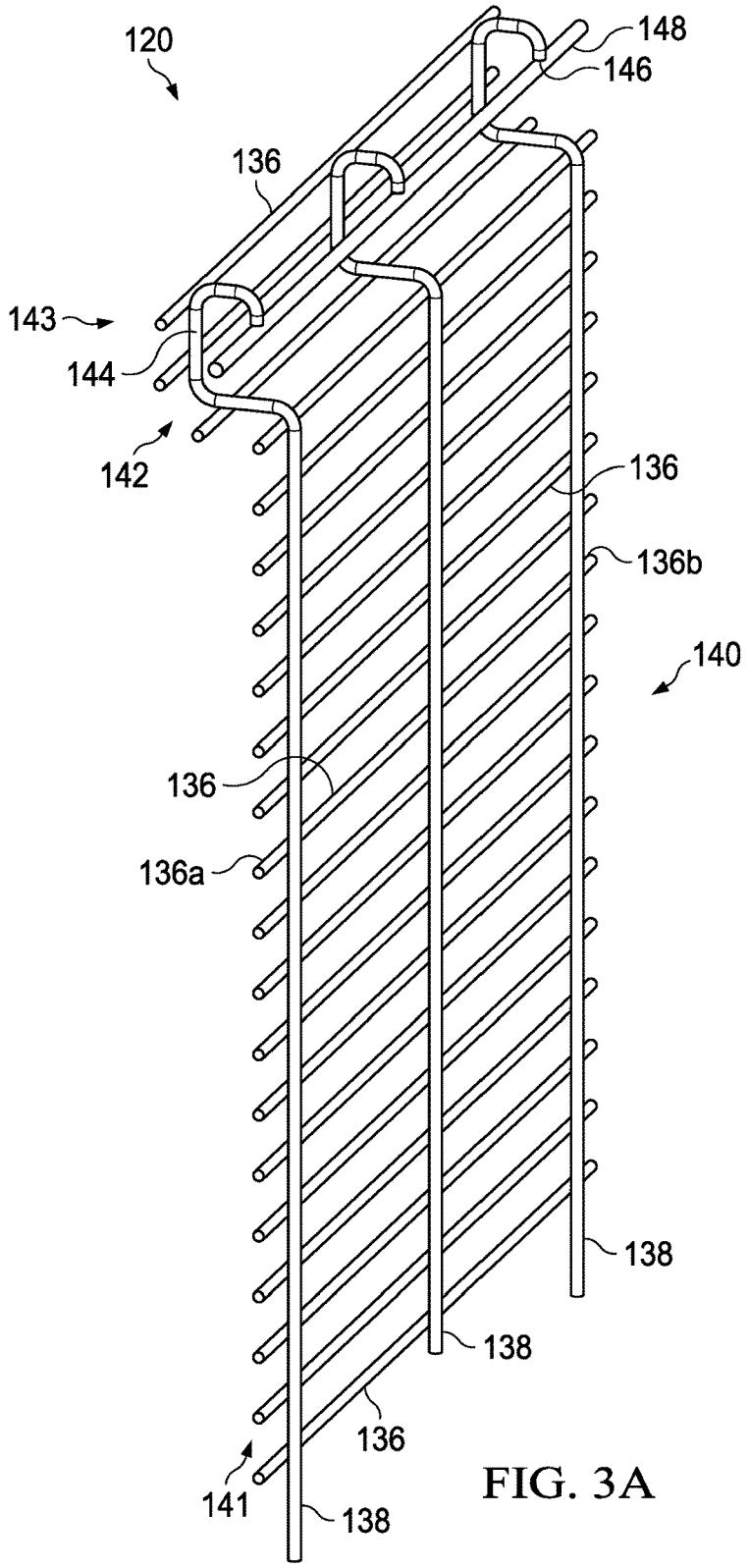
FIG. 3A is a schematic, perspective view of the swing gate of FIG. 2.
Figure 3B:
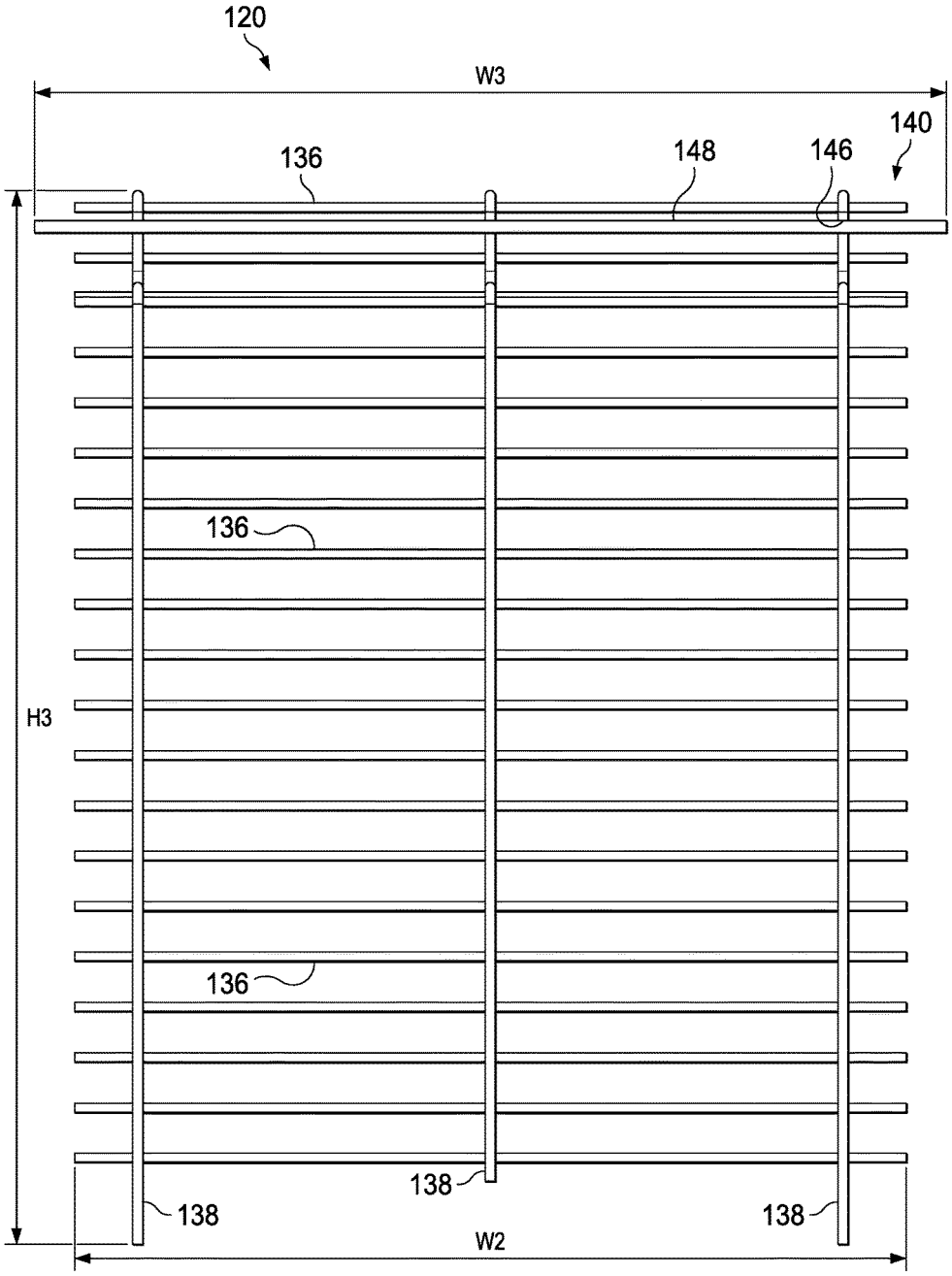
FIG. 3B is a schematic, back view of the swing gate of FIG. 2.
Figure 3C:
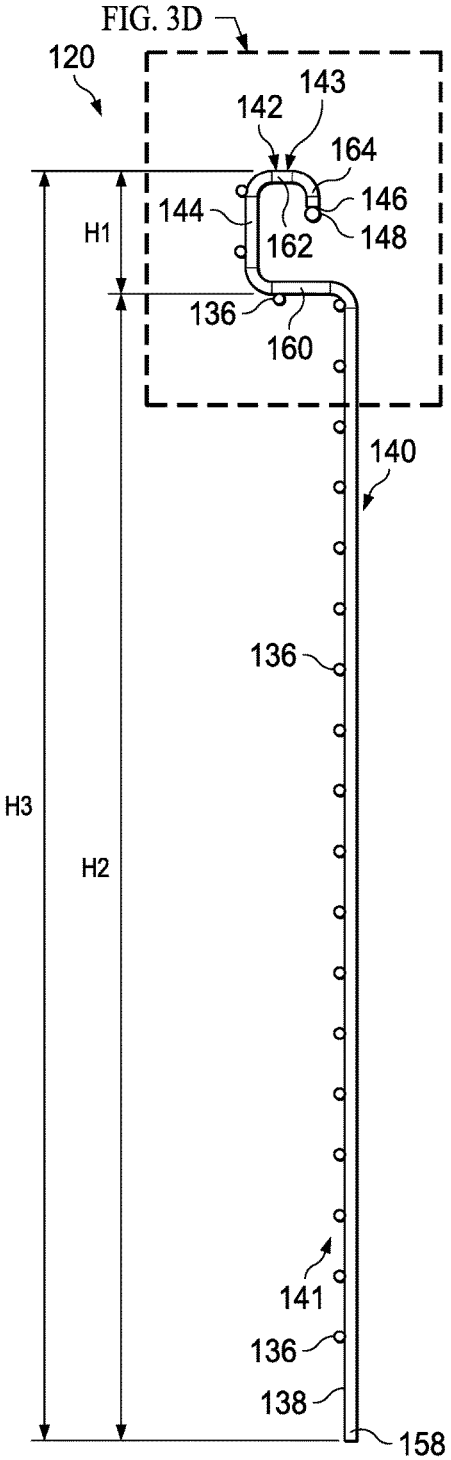
FIG. 3C is a schematic, side view of the swing gate of FIG. 2.
Figure 3D:
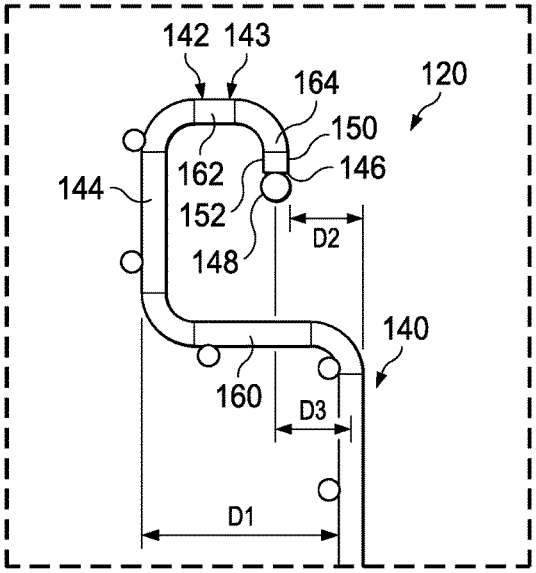
FIG. 3D is a schematic, detailed view of a portion of the swing gate of FIG. 3C.

In some embodiments, the curved section 142 is generally C-shaped as viewed in FIG. 3C. The curved section 142 may include a back portion 144 that is laterally offset from the vertical section 140 a first distance D1 (FIG. 3D). The curved section 142 includes a terminus 146 that is laterally offset from the vertical section 140 by a second distance D2. The first distance D1 is greater than the second distance D2. Both the back portion 144 and the terminus 146 are offset laterally from the vertical section 140 in the same direction, which is toward the interior 117 of the condenser unit housing 116.

Still referring to FIGS. 3A-3D, with continued reference to FIG. 2, when the swing gate 120 is in the closed position 122, the curved section 142 of the second plurality of rods 138, in some aspects, may have a first horizontal leg 160 extending backwards from the vertical section 140 towards the interior 117 of the housing 116. The back portion 144, which also may be referred to as a first vertical leg, extends upward from the first horizontal leg 160. A second horizontal leg 162 extends forward from the back portion 144 away from the interior 117 of the housing 116. A second vertical leg 164 extends downward from the second horizontal leg 162 with the terminus 146 being on the second vertical leg 164. The terminus 146 is on a distal end of the second vertical leg 164. The first vertical leg or the back portion 144 is offset from the vertical section 140 of the second plurality of rods 138 by the first distance D1, and the second vertical leg 164 is offset from the vertical section 140 by the second distance D2, which is less than the first distance D1. In another embodiment, a bend or parallel vertical leg 167

(FIG. 5B) may be included. With reference still to FIG. 5B, in one embodiment, the extra bend 167 is omitted and the pivot rod 148 is about where the bend to vertical leg/bend 167 begins and is substantially on the horizontal line where 148 is currently shown in FIG. 5B.

The swing gate 120 further includes a pivot rod 148 (FIG. 3A) that extends in the horizontal direction and is coupled to the curved section 142 of the second plurality of rods 138. In some embodiments, the pivot rod 148 is coupled to the terminus 146. However, it should be appreciated that the pivot rod 148 may be connected to either a front portion 150 or back portion 152 of the second plurality of rods 138 proximate the terminus 146. In a nonlimiting embodiment, the pivot rod 148 may be formed of 7 gauge rods, 8 gauge rods, 9 gauge rods, 10 gauge rods or the like and may extend parallel to the first plurality of rods 136. In an illustrative embodiment, the pivot rod 148 has a larger diameter (smaller gauge rod) than the diameter of the first plurality of rods 136 and the second plurality of rods 138. The pivot rod 148 may partially or fully support the weight of the swing gate 120 when in the closed position 122.

The pivot rod 148 has a width W3 (FIG. 3B) that is greater than the width W1 of the access opening 118. Thus, the width W3 of the pivot rod 148 is also greater than the width W2 of the first plurality of rods 136. Based on the corresponding widths of the first plurality of rods 136, the access opening 118 framed by the first sidewall 130 and the second sidewall 132, and the pivot rod 148, it should be appreciated that the pivot rod 148 extends beyond both the first sidewall 130 and the second sidewall 132 when the swing gate 120 is connected to the condenser unit housing 116. The pivot rod's 148 orientation relative to the first sidewall 130 and the second sidewall 132 will be discussed in more detail below relative to FIGS. 6A-6D, which relate to the assembly of the swing gate 120 to the condenser unit housing 116.

The pivot rod 148 is offset from the vertical section 140 of the second plurality of rods 138 a distance D3 (FIG. 3D). The pivot rod 148 is offset from the vertical section 140 of the second plurality of rods 138 in the same direction as the back portion 144 and the terminus 146. The distance D3 that the pivot rod 148 is offset from the vertical section 140 may be substantially equal to the distance D2 that the terminus 146 is offset from the vertical section 140.

The height H3 of the swing gate 120 extends from an uppermost portion 156 (FIG. 3C) of the swing gate 120 to a lowermost portion 158 of the swing gate 120. The terminus 146 and the pivot rod 148 are between the uppermost portion 156 and the lowermost portion 158 of the swing gate 120. In some embodiments, the terminus 146 and the pivot rod 148 are positioned in the range of approximately 4 to 10 percent of the height H3 of the swing gate 120 from the uppermost portion 156 of the swing gate 120. For example, if the height H3 of the swing gate 120 is 16 feet (4.8 meters), then the terminus 146 or the pivot rod 148 may be approximately in the range of 0.64 to 1.6 feet (19.5 cm to 48.8 cm) below the uppermost portion 156 of the swing gate 120 when the swing gate 120 is in the closed position 122.

Figure 4A:
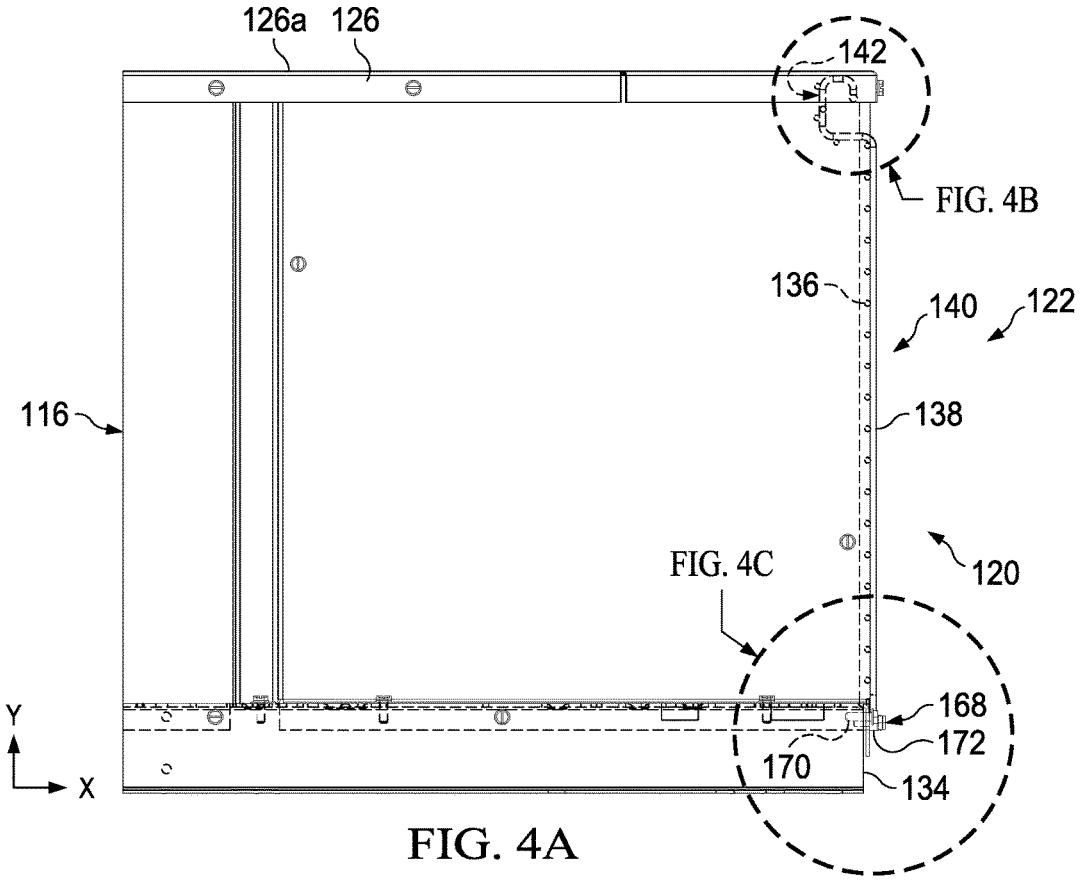
FIG. 4A is a schematic, side view of the condenser unit housing and swing gate of FIG. 2 when the swing gate is in a closed position.
Figure 4B:
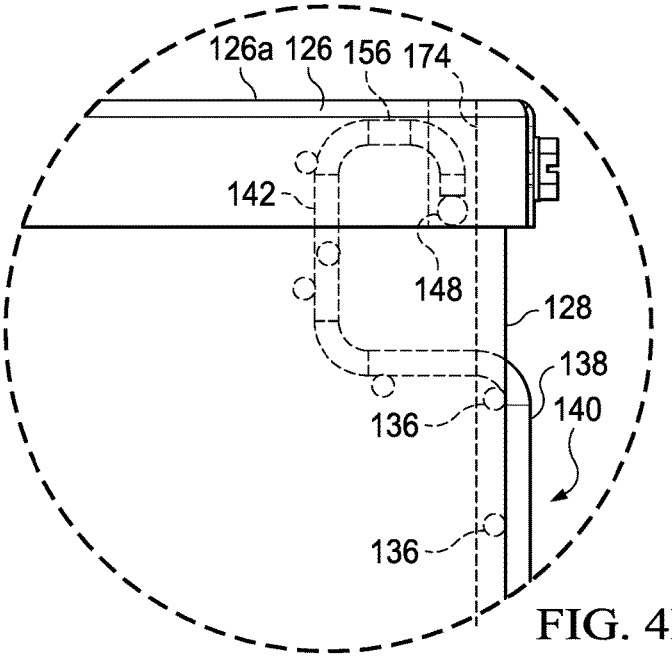
FIG. 4B is a schematic, detailed view of a portion of the condenser unit housing and swing gate as shown in FIG. 4A.
Figure 4C:
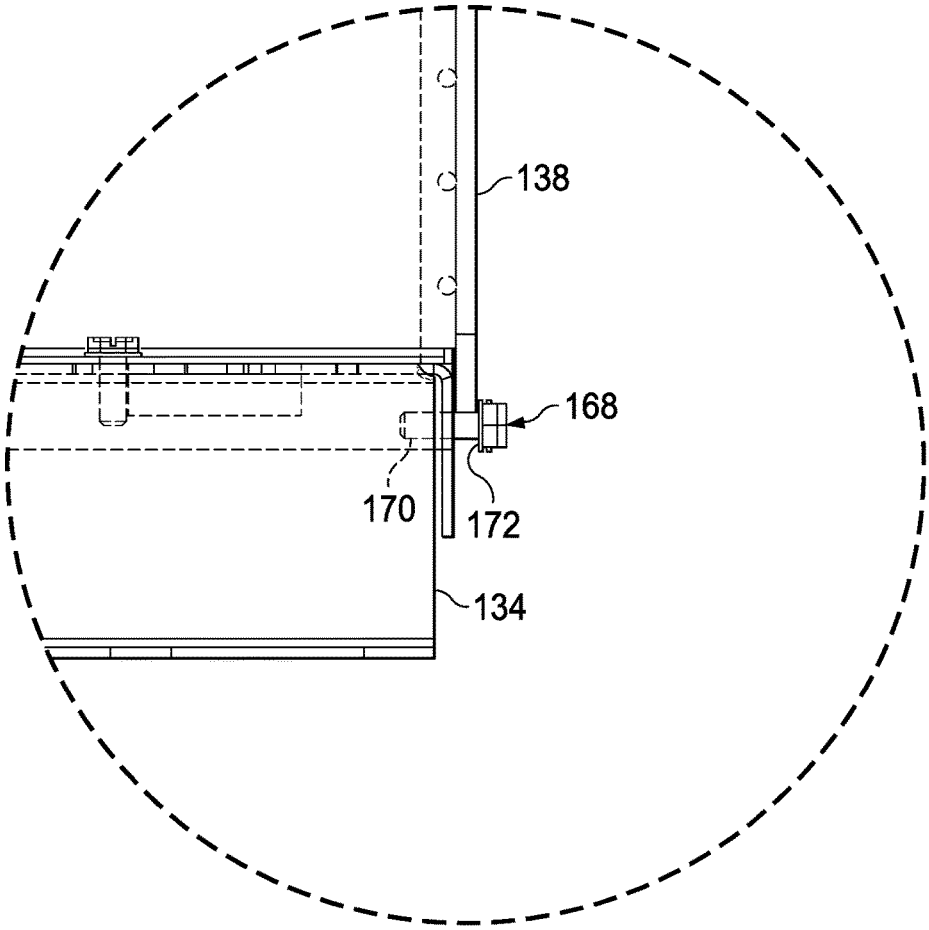
FIG. 4C is a schematic, detailed view of a portion of the condenser unit housing and swing gate as shown in FIG. 4A.

Referring now primarily to FIGS. 4A-4C, in one illustrative embodiment, a side view of the condenser unit housing 116 with the swing gate 120 in the closed position 122 is presented. When the swing gate 120 is in the closed position 122, the uppermost portion 156 of the swing gate 120 is below an uppermost portion 126*a* of the top cover 126. The second plurality of rods 138 in the vertical section 140 are positioned external to the exterior 128 of the housing 116 with the first plurality of rods 136 connected to the vertical section 140 being internal to the exterior 128 of the housing 116. The curved section 142 is interior to the exterior 128 of the housing 116. In an illustrative embodiment, the first plurality of rods 136 are positioned within the housing 116 when the swing gate 120 is in the closed position 122. The pivot rod 148 is supported by at least a first aperture or slot 174 formed in the first sidewall 130. In operation, the swing gate 120 rotates or otherwise pivots about the pivot rod 148 in at least the first aperture 174. In other embodiments, the position of the bars could be reversed.

Figure 5A:
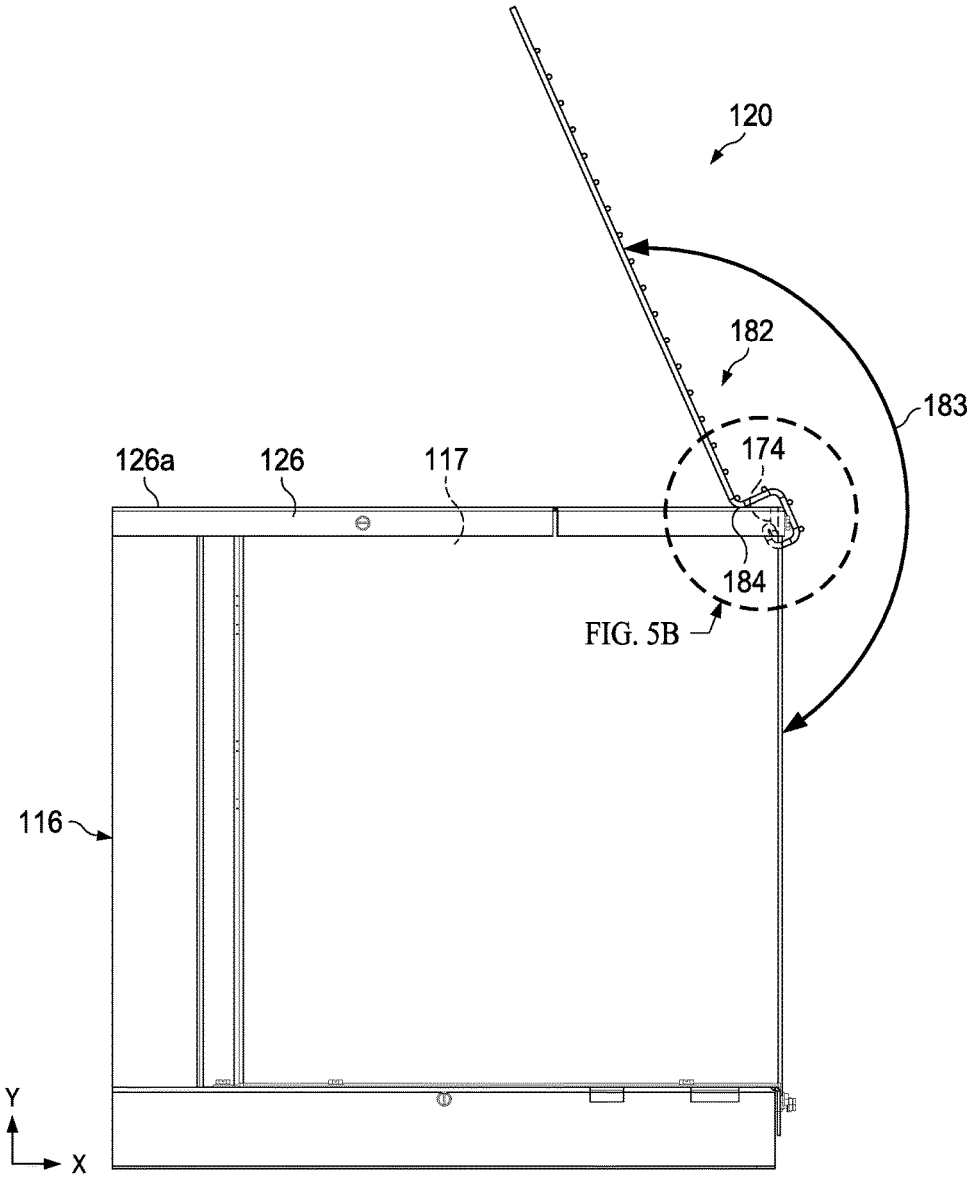
FIG. 5A is a schematic, side view of the condenser unit housing and swing gate of FIG. 2 when the swing gate is a fully open position.
Figure 5B:
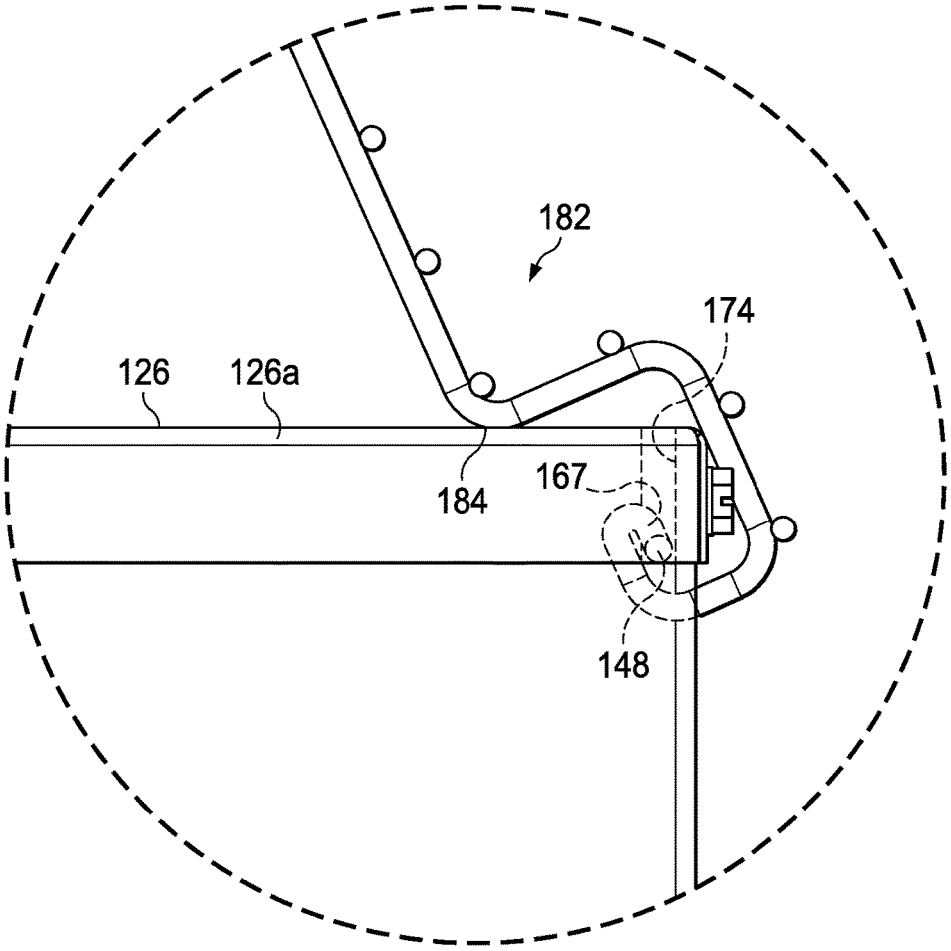
FIG. 5B is a schematic, detailed view of a portion of the condenser unit housing and swing gate as shown in FIG. 5A
Figure 6A:
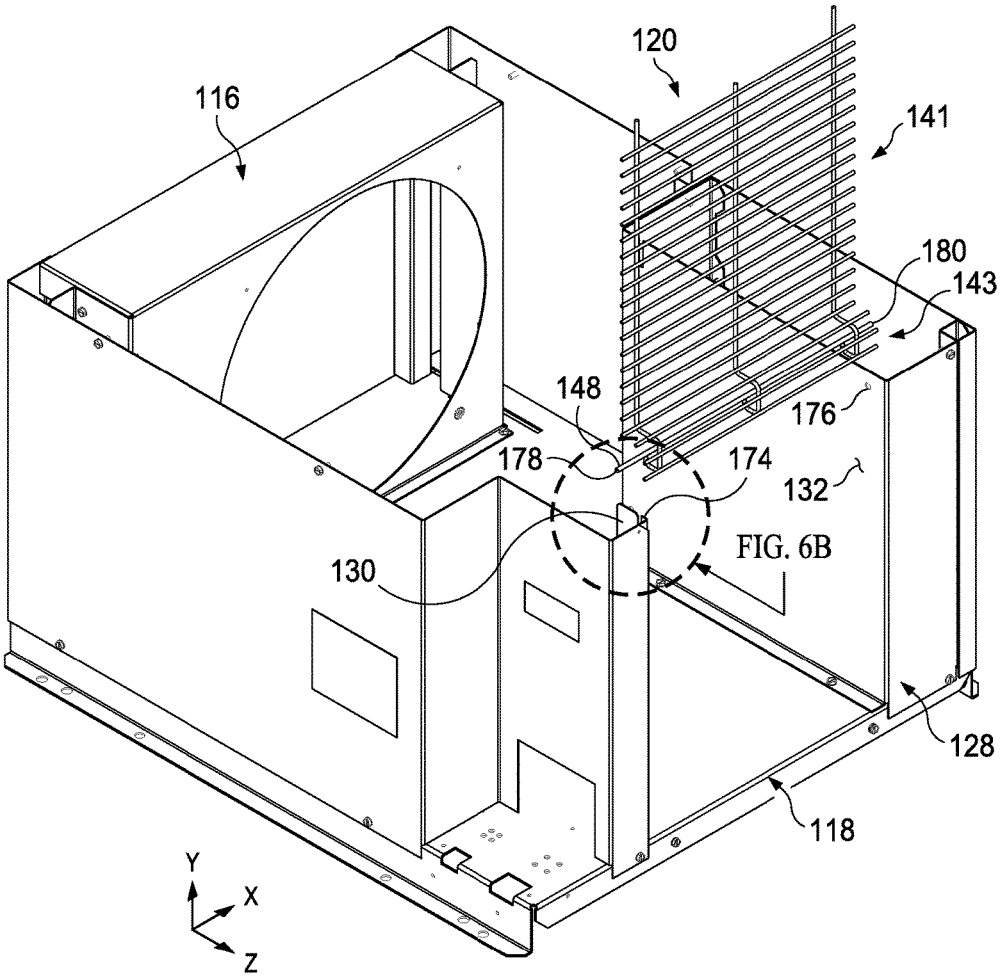
FIG. 6A is a schematic, partial, perspective view illustrating assembly of the swing gate to the condenser unit housing.
Figure 6B:
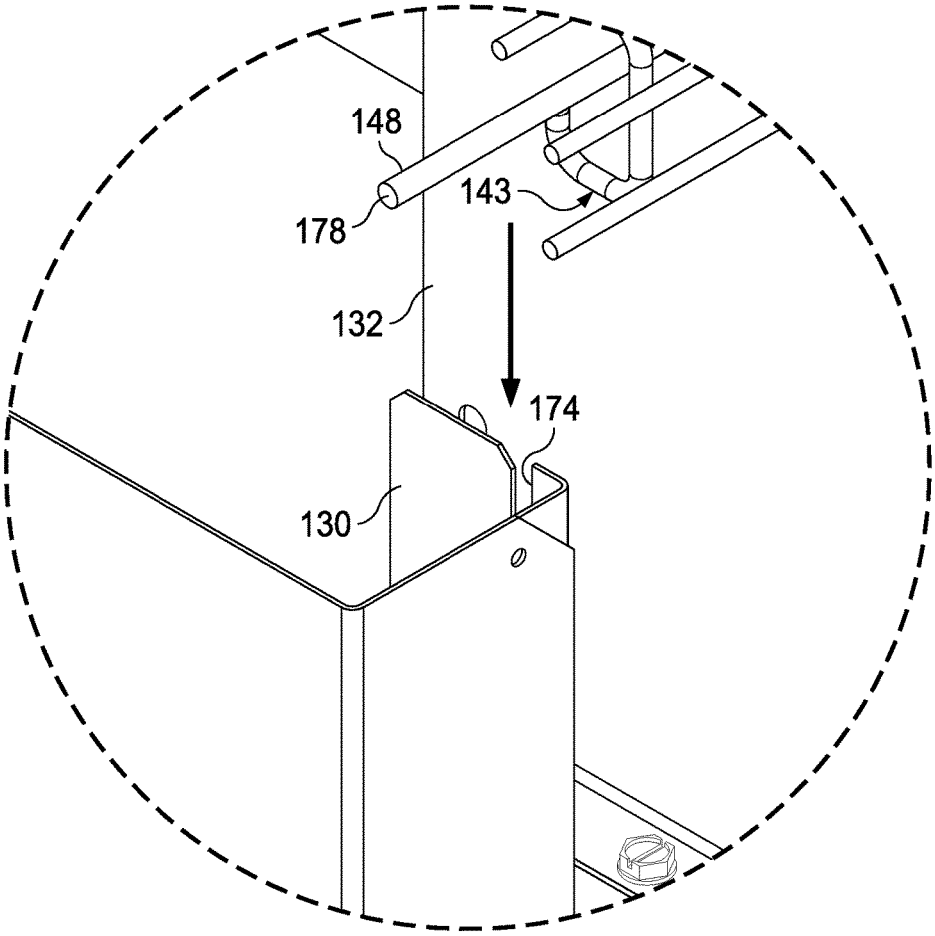
FIG. 6B is a schematic, detailed view of a portion of the swing gate and condenser unit housing according to FIG. 6A.
Figure 6C:
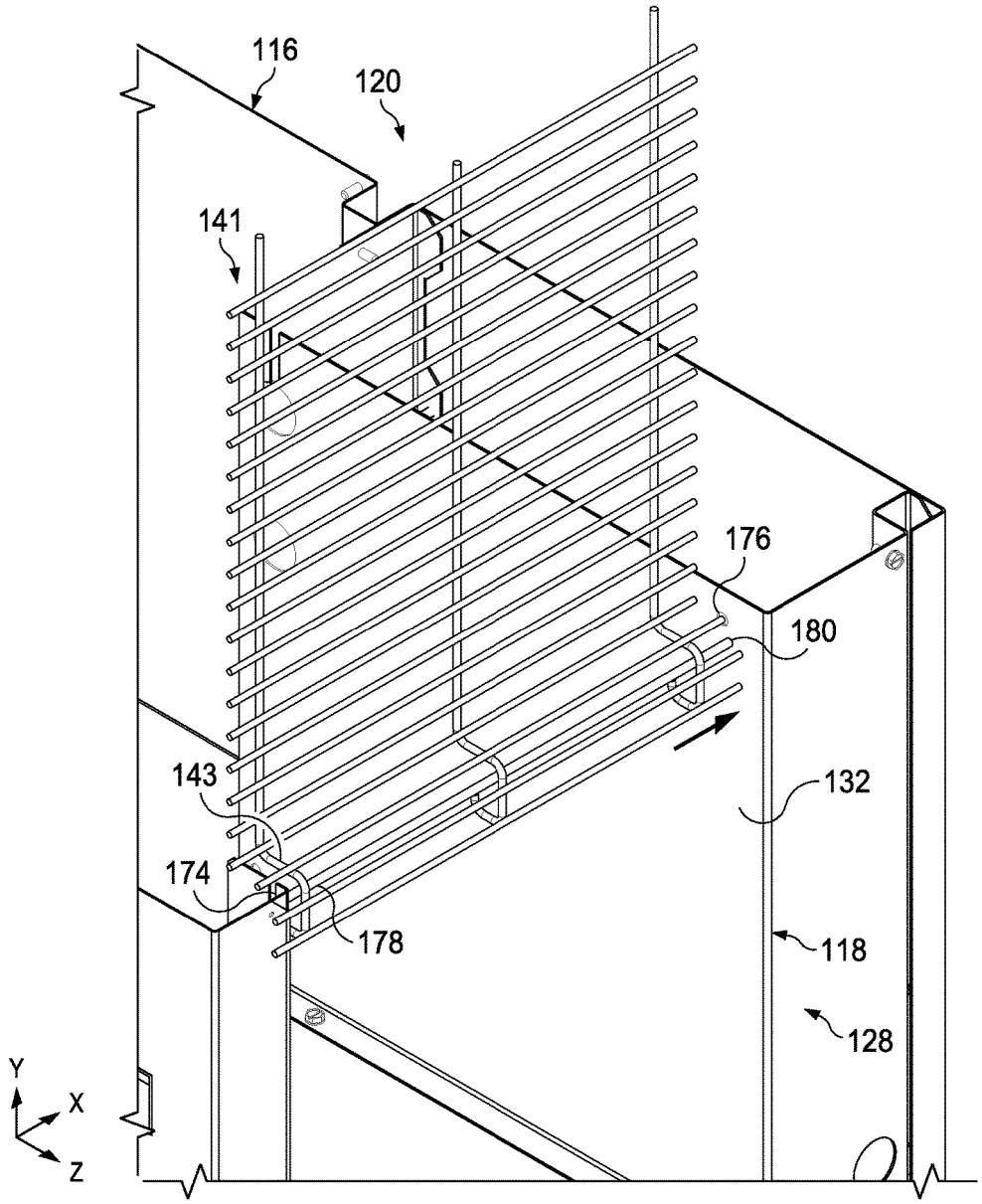
FIG. 6C is a schematic, partial, perspective view illustrating assembly of the swing gate to the condenser unit housing, according to an illustrative embodiment.
Figure 6D:
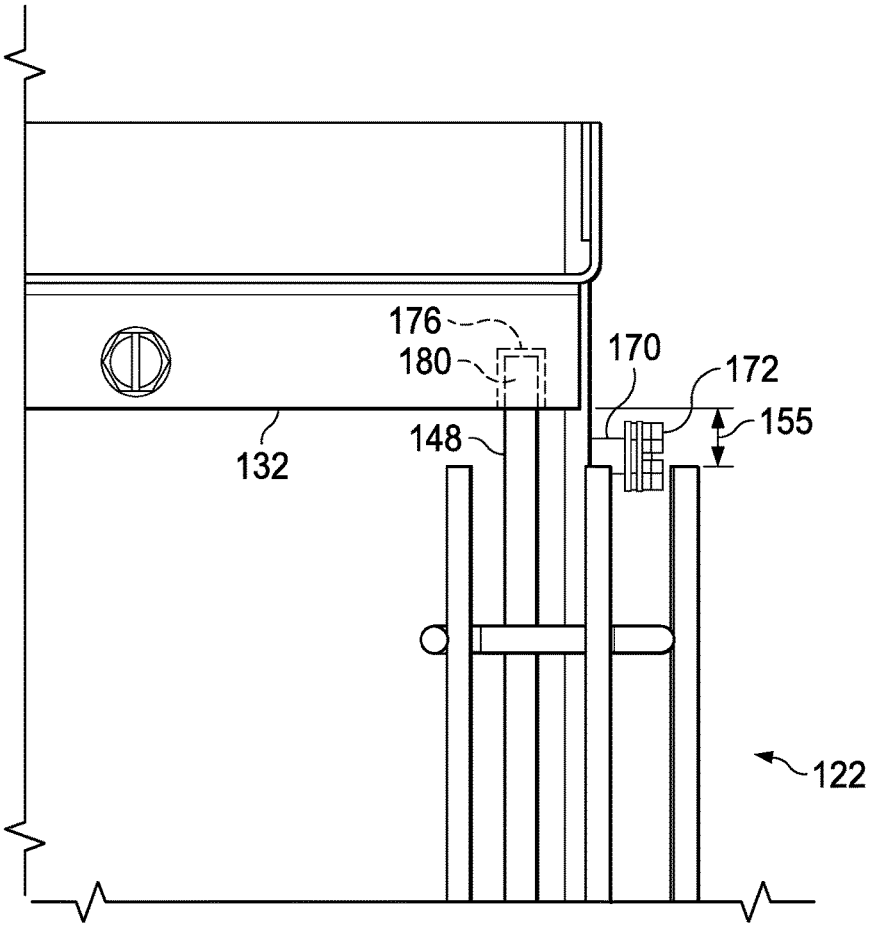
FIG. 6D is a schematic, partial top view of the swing gate in the open position after assembly of the swing gate and the condenser unit housing.

Referring now primarily to FIGS. 5A-5B, a side view of the condenser unit housing 116 with the swing gate 120 in an open position 182 is presented. When the swing gate 120 is in the open position 182, a portion 184 of the swing gate 120 contacts or otherwise rests on the uppermost portion 126*a* of the top cover 126. In some embodiments, the portion 184 of the swing gate 120 that contacts the uppermost portion 126*a* of the top cover 126 may be a portion of the curved section 142 of the second plurality of rods 138. Resting the swing gate 120 on the top cover 126 allows the swing gate 120 to remain attached to the condenser unit housing 116 without obstructing a user's access to the interior 117 of the housing 116. In some embodiments, the swing gate 120, when in the open position 182 may be angled relative to the exterior 128 of the housing 116 at an angle 183 that is greater than 180 degrees. In an illustrative embodiment, the angle 183 of the swing gate 120, when in the open position 182, is between approximately 240 and 260 degrees. In operation, the swing gate 120 rotates or otherwise pivots about the pivot rod 148 when the swing gate 120 is moved from the closed position 122 (see FIGS. 4A-4C) into the open position 182. The angle 183 may be selected to provide adequate force to hold the swing gate 120 in position.

Referring now to FIGS. 6A-6D, an illustrative method for assembling the swing gate 120 to the condenser unit housing 116 is presented. The top cover 126 of the housing 116, shown in previous figures, is removed from or otherwise unattached to the condenser unit housing 116 during the assembly process. As previously described, the access opening 118 is defined at least partially by the first sidewall 130 and the second sidewall 132. The first sidewall 130 and the second sidewall 132 both include apertures for which the pivot rod 148 extends through. The first sidewall 130 includes the first aperture or slot 174 (FIG. 6B) formed therein for receiving a first end 178 of the pivot rod 148. The first aperture 174, as shown, is U-shaped with the opening extending from a top of the first sidewall 130. It should be appreciated, however, that in other embodiment the first aperture 174 may be a fully enclosed opening extending through the first sidewall 130. The second sidewall 132 includes a second aperture or slot 176 (FIGS. 6A and 6C) formed therein for receiving a second end 180 of the pivot rod 148. The second aperture 176, as shown, is a fully enclosed opening extending through the second sidewall 132. It should be appreciated, however, that in other embodiments the second aperture 176 may be U-shaped with the opening extending from the top of the second sidewall 132. The first aperture 174 and the second aperture 176 may be any combination of a U-shaped opening or a fully enclosed opening.

In operation, the swing gate 120 is oriented in an upside-down position (see FIG. 6C), such that the curved section 143 of the swing gate 120 is below the straight section 141 of the swing gate 120, and the swing gate 120 is generally aligned vertically with the access opening 118. In some embodiments, the swing gate 120 is horizontally offset from the access opening 118 such that a portion of the first plurality of rods 136 overlap the first sidewall 130 when the swing gate 120 is oriented in the upside-down position. The swing gate 120 is lowered toward the access opening 118 and the first aperture 174 until the pivot rod 148 slips into or otherwise engages the first aperture 174. The first aperture 174 cradles a first end 178 of the pivot rod 148. In some embodiments, once the first end 178 of the pivot rod 148 is positioned in the first aperture 174, the second end 180 of the pivot rod 148 is horizontally aligned with the second aperture 176 formed in the second sidewall 132. With the swing gate 120 gate still in an upside-down position, the swing gate 120 is slid horizontally or laterally towards the second aperture 176 in the second sidewall 132 until the second end 180 of the pivot rod 148 engages the second aperture 176 and the first plurality of rods 136 no longer overlap the first sidewall 130. The swing gate 120 is then rotated about the pivot rod 148 until the swing gate 120 is in the closed position 122. The first sidewall 130 and the second sidewall 132 supports the swing gate 120 via the pivot rod 148.

Figure 7A:
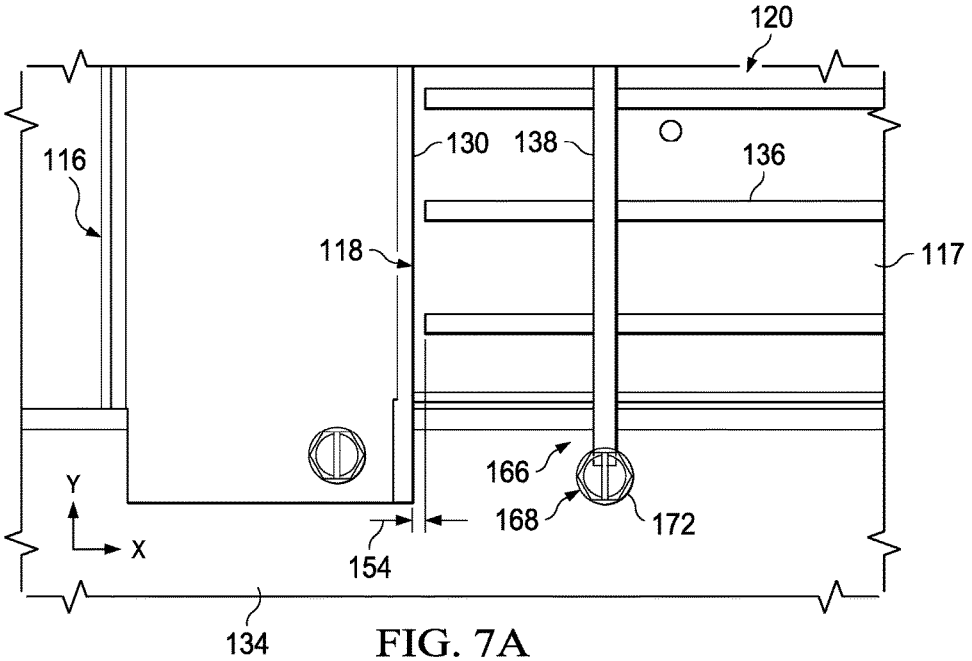
FIG. 7A is a schematic, front, partial view of the condenser unit housing and swing gate of FIG. 2 in a locked position, according to an embodiment.
Figure 7B:
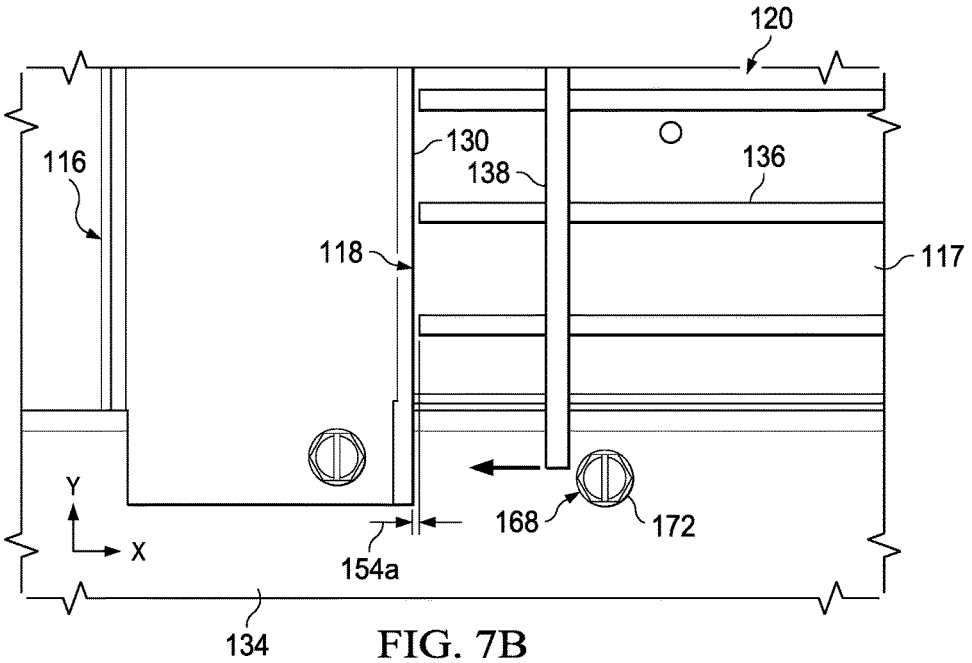
FIG. 7B is a schematic, front, partial view of the condenser unit housing and swing gate of FIG. 7A in an unlocked position, according to an embodiment.

Referring now primarily to FIGS. 7A-7B, a front view of the condenser unit housing 116 with the swing gate 120 in the closed position 122 and further shown in a locked position 166, according to an illustrative embodiment, is presented. The bottom panel 134 includes apertures (not explicitly shown) formed therein for receiving a plurality of fasteners 168, where the fasteners 168 are operable to be backed into or out of the apertures relative to the bottom panel 134. The fasteners 168 include a body portion 170 (see FIG. 6A) and a face portion 172. In some embodiments, the fasteners 168 may be screws. The fasteners 168 may further include washers (not shown) that are positioned between the face portion 172 of the fasteners 168 and the second plurality of rods 138. A bottommost portion of one or more of the second plurality of rods 138 may contact or otherwise rests against the body portion 170 of the fasteners 168. In some aspects, the bottommost portion of the second plurality of rods 138 contacts or rests against an upper surface of the fastener's 168 body portion 170.

When the swing gate 120 is in the locked position 166, the fasteners 168 press one or more of the second plurality of rods 138 against the bottom panel 134 to prevent the one or more second plurality of rods 138 and, correspondingly, the swing gate 120 from moving relative to the bottom panel 134. In some aspects, either the face portion 172 of the fasteners 168 or a washer is used to press against the second plurality of rods 138, thereby sandwiching the second plurality of rods 138 between the bottom panel 134 and the fastener 168. To release the swing gate 120 from the locked position 166, the fasteners 168 may be backed out of the apertures so that the second plurality of rods 138 are no longer pressed against the bottom panel 134. Even though the fasteners 168 may have been backed out of the apertures to allow the second plurality of rods 138 freedom of movement, the fasteners 168 may still be at least partially positioned within the apertures so that the fasteners 168 remain attached to the bottom panel 134 even with the swing gate 120 is in the unlocked position.

In operation, a user may access the interior 117 of the condenser unit housing 116 by first unlocking the swing gate 120. The swing gate 120 is unlocked by loosening the plurality of fasteners 168 from the bottom panel 134 of the housing 116 until the swing gate 120 is operable to move laterally relative to the bottom panel 134. The plurality of fasteners 168 may remain connected to the bottom panel 134 when the swing gate 120 is in the unlocked position. In some aspects, the body portion 170 of the plurality of fasteners 168 remains engaged with the apertures within the bottom panel 134 even when the swing gate 120 is in the unlocked position. Once the swing gate 120 is unlocked, at least a portion of the swing gate is slid laterally relative to the access opening 118 (FIG. 7B). In some embodiments, when the swing gate 120 is slid laterally towards the first sidewall 130, causing the gap 154 between the first plurality of rods 136 and the first sidewall 130 to narrow and form a gap 154*a* (FIG. 7B). The gap 154 may otherwise be substantially eliminated such that the first plurality of rods 136 contacts the first sidewall 130. It should be appreciated that as the first gap 154 narrows, the second gap 155 on the other end (see FIG. 6D) increases. The swing gate 120 is then rotated about the pivot rod 148 until a portion of the swing gate 120 contacts the top cover 126 of the condenser unit housing 116. In some embodiments, the curved section 142 of the second plurality of rods 138 contacts the top cover 126.

Figure 8A:
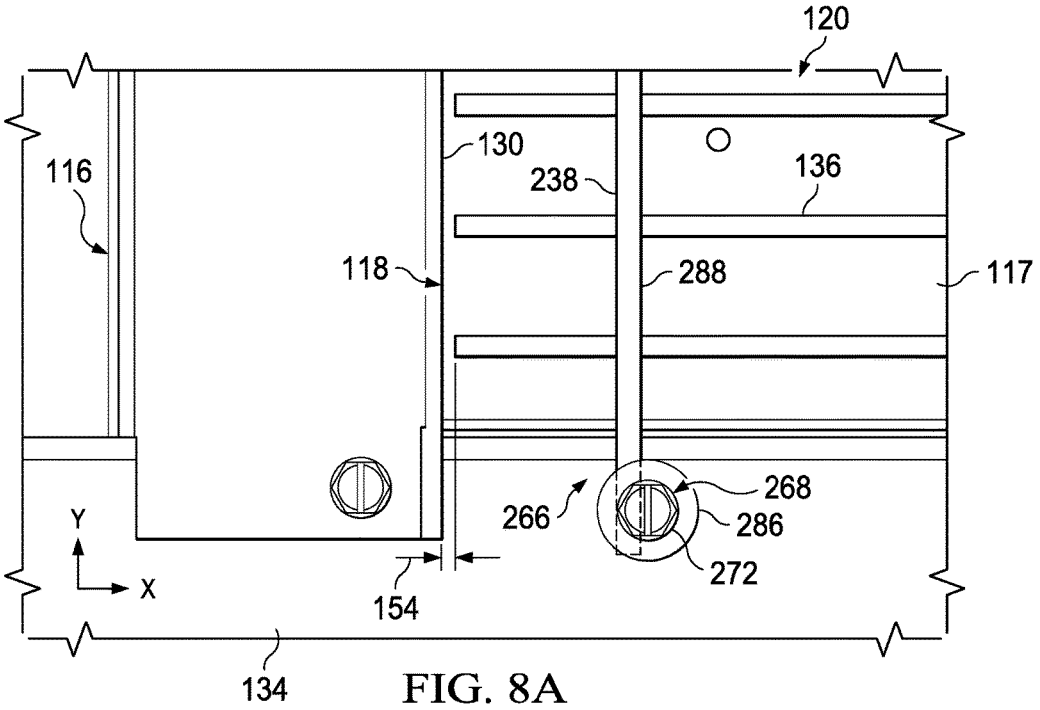
FIG. 8A is a schematic, front, partial view of the condenser unit housing and swing gate in a locked position, according to an embodiment.
Figure 8B:
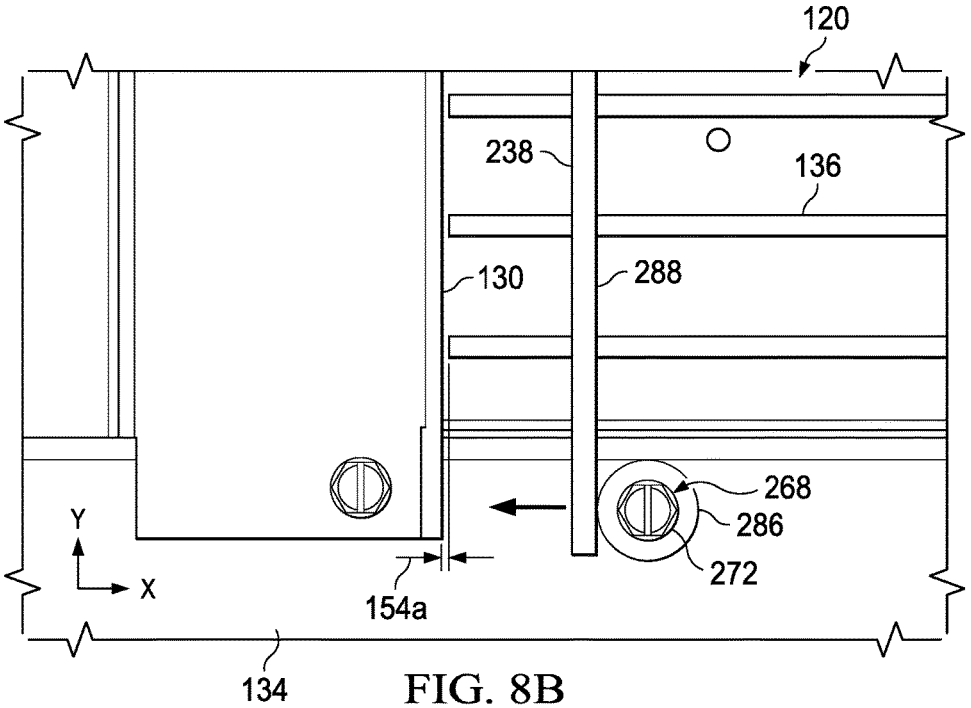
FIG. 8B is a schematic, front, partial view of the condenser unit housing and swing gate of FIG. 8A in an unlocked position, according to an embodiment.

Referring now to FIGS. 8A-8B, another embodiment of the swing gate 120 in a locked position 266 is presented. In this embodiment, the swing gate 120 includes a second plurality of rods 238 having a side portion 288 with sufficient length to extend along the side of a plurality of fasteners 268. In this embodiment, the plurality of fasteners 268 include washers 286. The plurality of fasteners 268 may be similar to the fasteners 168 described above in that the plurality of fasteners 268 include a face portion 272 and a body portion (not explicitly shown) like that of the fasteners 168. The body portion of the plurality of fasteners 268 is configured to extend into and engage the apertures (not explicitly shown) formed in the bottom panel 134. In some embodiments, the plurality of fasteners 268 may be screws.

When the swing gate 120 is in the locked position 266, the fasteners 268 press one or more of the second plurality of rods 238 against the bottom panel 134 to prevent the swing gate 120 from moving relative to the bottom panel 134. As shown in FIG. 8A, the side portion 288 of the second plurality of rods 238 may contact a side of the body portion of the plurality of fasteners 268 in the locked position 266. In some aspects, the washers 286 are used to press the second plurality of rods 238 against the bottom panel 134, thereby sandwiching the second plurality of rods 238 between the bottom panel 134 and the washer 286.

To release the swing gate 120 from the locked position 266, the fasteners 268 may be partially or fully backed out of the apertures so that the second plurality of rods 238 are no longer pressed against the bottom panel 134. In embodiments where the fasteners 268 are only partially backed out of the apertures, at least a portion of the plurality of fasteners 268 remain connected to the bottom panel 134. The swing gate 120 may then be moved laterally (FIG. 8B).

In operation, a user may access the interior 117 of the condenser unit housing 116 by first unlocking the swing gate 120. The swing gate 120 is unlocked by loosening the plurality of fasteners 268 from the bottom panel 134 of the housing 116 until the swing gate 120 is operable to move laterally relative to the bottom panel 134. The plurality of fasteners 268 may remain connected to the bottom panel 134 when the swing gate 120 is in the unlocked position. Once the swing gate 120 is unlocked, at least a portion of the swing gate 120 is slid laterally relative to the access opening 118 (FIG. 8B). In some embodiments, when the swing gate 120 is slid towards the first sidewall 130, the gap 154 between the first plurality of rods 136 and the first sidewall 130 is narrowed to form the gap 154*a*. In yet some embodiments, the gap 154 may otherwise be substantially eliminated such that the first plurality of rods 136 contacts the first sidewall 130. The swing gate 120 is then rotated about the pivot rod 148 until a portion of the swing gate 120 contacts the top cover 126 of the condenser unit housing 116. In some embodiments, the curved section 142 of the second plurality of rods 138 contacts the top cover 126.

Figure 9C:
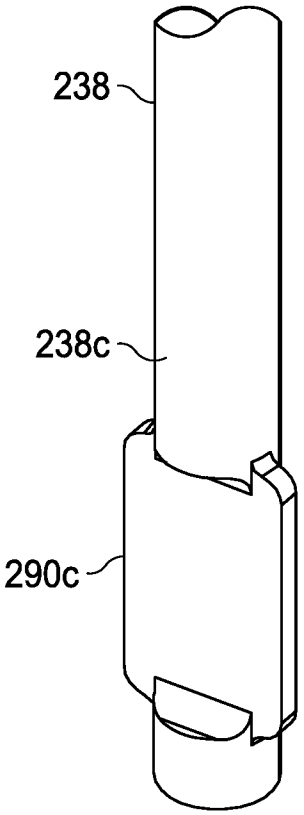
FIG. 9C is a partial, schematic view of a rod locking component, according to an illustrative embodiment.
Figure 9B:
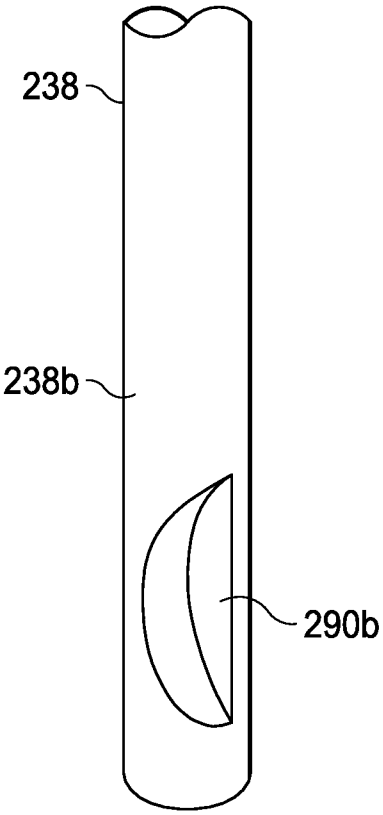
FIG. 9B is a partial, schematic view of a rod locking component, according to an illustrative embodiment.
Figure 9A:
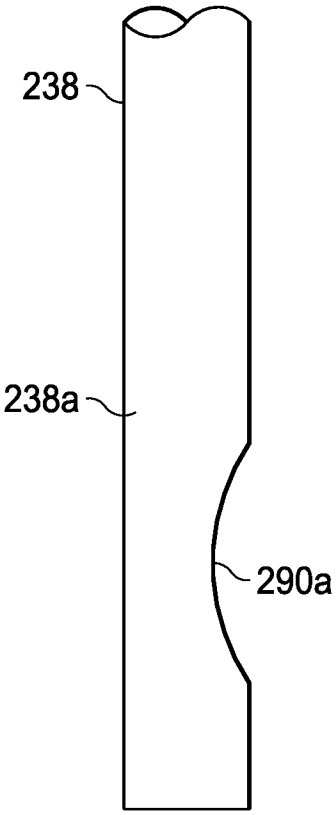
FIG. 9A is a partial, schematic view of a rod locking component, according to an illustrative embodiment.

Referring now primarily to FIGS. 9A-9C, but with continued reference to FIGS. 8A-8B, alternative embodiments are presented for securing the second plurality of rods 238 to the bottom panel 134 of the condenser unit housing 116.

FIG. 9A illustrates an alternative embodiment of a bottom portion 238*a* of the second plurality of rods 238. The bottom portion 238*a* includes a cut-out 290*a* formed therein. The cut-out 290*a* is operable to engage a portion of the plurality of fasteners 268. The cut-out 290*a* may provide for a greater contact area between the bottom portion 238*a* and the plurality of fasteners 268 when the swing gate 120 is in the locked position 266.

FIG. 9B illustrates an alternative embodiment of a bottom portion 238*b* of the second plurality of rods 238. The bottom portion 238*b* includes a half counter-sink 290*b* formed therein. The half counter-sink 290*b* is operable to engage a portion of the plurality of fasteners 268. The half counter-sink 290*b* may provide for a greater contact area between the bottom portion 238*a* and the plurality of fasteners 268 when the swing gate 120 is in the locked position 266.

FIG. 9C illustrates an alternative embodiment of a bottom portion 238*c* of the second plurality of rods 238. The bottom portion 238*c* includes a coin or flatten portion 290*c* formed therein. The coin or flatten portion 290*c* is operable to engage a portion of the plurality of fasteners 268. The coin or flatten portion 290*c* may provide for a greater contact area between the bottom portion 238*a* and the plurality of fasteners 268 when the swing gate 120 is in the locked position 266.

The various swing grill embodiments referenced herein offer advantages. Among the possible advantages are that the swing grill has no fasteners/hinges required to enable the swinging between open and closed positions; the swing grill does not need to be removed for unit servicing and the swing grill rests on top of the unit with minimal resting area on the top panel; and the hole and slot that are used for axis rotation of the swing grill are under the top panel which helps prevent rain entry into the electrical box.

In the detailed description herein of the preferred embodiments, reference is made to the accompanying drawings that form a part hereof, and in which is shown, by way of illustration, specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The detailed description is, therefore, not to be taken in a limiting sense, and the scope of the present invention is defined only by the claims. Unless otherwise indicated, as used throughout this document, "or" does not require mutual exclusivity.

Although the present invention and its advantages have been disclosed in the context of certain illustrative, non-limiting embodiments, it should be understood that various changes, substitutions, permutations, and alterations can be made without departing from the scope of the invention as defined by the claims. It will be appreciated that any feature that is described in a connection to any one embodiment may also be applicable to any other embodiment.

What is claimed:

1. A refrigeration system for cooling a climate-controlled area, the refrigeration system comprising:

a closed refrigeration circuit comprising:

a plurality of fluidly coupled conduits, a condenser fluidly coupled to the plurality of conduits, an expansion valve fluidly coupled to the plurality of conduits, an evaporator fluidly coupled to the plurality of conduits, and a compressor fluidly coupled to the plurality of conduits; and wherein the condenser comprises:

a condenser unit housing having a plurality of sidewalls and a top cover, an access opening formed on an exterior of the condenser unit housing, the access opening being at least partially framed by a first sidewall and a second, opposing sidewall, the access opening having an access-opening width W1 between the first sidewall and the second sidewall, a swing gate operable to cover the access opening in a closed position, the swing gate comprising:

a first plurality of rods extending in a horizontal direction having a width W2 that is less than the access-opening width W1, a second plurality of rods coupled to the first plurality of rods, the second plurality of rods substantially perpendicular to the first plurality of rods, wherein the second plurality of rods includes a vertical section that is vertical when in the closed position and includes a curved section, wherein the curved section includes a back portion laterally offset from the vertical section a first distance D1, and a terminus laterally offset from the vertical section a second distance D2, wherein the first distance D1 is greater than the second distance D2, and a pivot rod extending in the horizontal direction and coupled to the terminus.

2. The system of claim 1, wherein the curved section is generally C-shaped in one side view.

3. The system of claim 1, wherein the swing gate has a vertical dimension D3 from an uppermost portion to a lowermost portion, and wherein the terminus is between the uppermost portion of the swing gate and five percent of D3 down the uppermost portion in the closed position.

4. The system of claim 1, wherein a portion of the curved section of the second plurality of rods rests against the top cover when the swing gate is in a fully open position.

5. The system of claim 1, wherein the pivot rod contacts the first sidewall and the second sidewall.

6. The system of claim 1, wherein the first sidewall includes a first aperture, the second sidewall includes a second aperture, and the pivot rod is operable to pivot relative to the first and second aperture.

7. The system of claim 1, wherein the curved section includes a first horizontal leg extending from the vertical section, the back portion being a first vertical leg and extending from the first horizontal leg, a second horizontal leg extending from the first vertical leg and a second vertical leg extending from the second horizontal leg, wherein the terminus is on a distal end of the second vertical leg, wherein the first vertical leg is offset from the vertical section the first distance D1 and the second vertical leg is offset from the vertical section the second distance D2.

8. A condenser unit for use in a refrigeration system, the condenser unit comprising:

a condenser unit housing having outer walls and a top cover;

an access opening formed in one of the outer walls of the housing, the access opening being at least partially framed by the top cover, a first sidewall and a second, opposing sidewall, the access opening having a width W1 between the first sidewall and the second sidewall; and a swing gate configured to be positioned within the access opening when the swing gate is in a closed position and contacting an upper surface of the top cover when the swing gate is in an open position, the swing gate comprising:

a first plurality of rods extending in a horizontal direction, the first plurality of rods having a width W2 that is less than the access-opening width W1, a second plurality of rods coupled to the first plurality of rods, the second plurality of rods extending in a direction different than the first plurality of rods, wherein the second plurality of rods include a straight section and a curved section, and a horizontal, pivot rod coupled to the second plurality of rods in the curved section, the horizontal, pivot rod having a width W3 that is greater than the width W1 of the access opening, wherein the horizontal, pivot rod is below the top cover in both the open position and the closed position.

9. The condenser unit of claim 8, wherein the curved section of the second plurality of rods includes a back portion laterally offset from the straight section a first distance D1, and a terminus laterally offset from the straight section a second distance D2, wherein the first distance D1 is greater than the second distance D2.

10. The condenser unit of claim 9, wherein the horizontal, pivot rod is coupled to the terminus.

11. The condenser unit of claim 8, wherein the curved section includes a first horizontal leg extending from the straight section, a first vertical leg extending from the first horizontal leg, a second horizontal leg extending from the first vertical leg and a second vertical leg extending from the second horizontal leg, wherein the first vertical leg is offset from the straight section a first distance D1 and the second vertical leg is offset from the straight section a second distance D2, wherein the first distance is greater than the second distance.

12. The condenser unit of claim 8, wherein the horizontal, pivot rod is connected to a terminus of the second plurality of rods.

13. The condenser unit of claim 8, wherein a portion of the curved section of the second plurality of rods contacts the top cover when the swing gate is in the open position.

14. The condenser unit of claim 8, wherein the access opening is further framed by a bottom panel that extends between the first sidewall and the second sidewall, wherein the swing gate is secured in the closed position with a washer held in place by a screw, wherein the one or more of the second plurality of rods are sandwiched between the bottom panel and the washer.

15. The condenser unit of claim 8 further comprising:

a bottom panel extending across a bottom portion of the access opening, the bottom panel having apertures formed therein; and a plurality of fasteners positioned in the apertures, wherein in a locked position the plurality of fasteners presses the second plurality of rods against the bottom panel to prevent the second plurality of rods from moving relative to the bottom panel.

16. The condenser unit of claim 15, wherein in an unlocked position the fasteners are loosened but still positioned in the apertures and the second plurality of rods are configured to move laterally relative to the bottom panel.

17. A method for accessing an interior of a condenser unit for use in a refrigeration system, the condenser having a housing with an access opening on an exterior of the housing and a swing gate for blocking the access opening in a closed position, the method comprising:

unlocking the swing gate from the housing, the housing having a plurality of sidewalls and a top cover, and the swing gate having a first plurality of rods in a horizontal direction having a width W2 less than an access-opening width W1, a second plurality of rods coupled to the first plurality of rods, wherein the second plurality of rods include a vertical section and a curved section, wherein in the curved section, the second plurality of rods are shaped to include a back portion laterally offset from the vertical section a first distance D1, and a terminus laterally offset from the vertical section a second distance D2, wherein the first distance D1 is greater than the second distance D2, and a pivot rod coupled to the terminus of at least some of the second plurality of rods, the pivot rod having a width W3 that is greater than the access-opening width W1;

sliding at least a portion of the swing gate laterally within the access opening; and rotating the swing gate about the pivot rod until the curved section of the second plurality of rods contacts the top cover of the housing.

18. The method of claim 17, wherein unlocking the swing gate includes loosening a fastener from a bottom panel of the housing until the swing gate is operable to move laterally relative to the bottom panel, wherein the fasteners remain connected to the bottom panel in an unlocked position.

19. The method of claim 17, wherein the swing gate slides laterally within the access opening until the first plurality of rods contacts a sidewall of the access opening.

20. The method of claim 17, wherein sliding at least the portion of the swing gate laterally within the access opening includes sliding the pivot rod laterally.

* * * * *